United States Patent [19]

Ghiardo

[11] Patent Number: 4,942,909

[45] Date of Patent: Jul. 24, 1990

[54] WEFT-FEELER WITH AUTOMATIC ADJUSTMENT OF THE DELAY TIME, FOR WEFT FEEDERS OF SHUTTLELESS LOOMS

[75] Inventor: Fiorenzo Ghiardo, Vigliano Biellese, Italy

[73] Assignee: ROJ Electrotex S.p.A., Biella, Italy

[21] Appl. No.: 291,306

[22] Filed: Dec. 28, 1988

[30] Foreign Application Priority Data

Dec. 31, 1987 [IT] Italy ..... 23296 A/87

[51] Int. Cl.[5] ..... D03D 51/34

[52] U.S. Cl. ..... 139/370.2; 139/452

[58] Field of Search ..... 139/370.2, 452

[56] References Cited

U.S. PATENT DOCUMENTS

| | | | |
|---|---|---|---|
| 4,041,985 | 8/1977 | Gotoh . | |
| 4,051,871 | 10/1977 | Vella . | |
| 4,095,621 | 6/1978 | Kakinaka | 139/370.2 |
| 4,326,564 | 4/1982 | Teixeira et al. . | |
| 4,556,088 | 12/1985 | Tanaka et al. | 139/370.2 |
| 4,617,971 | 10/1986 | Hellstroem | 139/370.2 |

FOREIGN PATENT DOCUMENTS

| | | |
|---|---|---|
| 2908743 | 9/1979 | Fed. Rep. of Germany . |
| 2333068 | 6/1977 | France . |
| WO81/02171 | 8/1981 | PCT Int'l Appl. . |

*Primary Examiner*—Andrew M. Falik

*Attorney, Agent, or Firm*—Young & Thompson

[57] ABSTRACT

A device for detecting weft yarn breakage is adapted to be positioned upstream of a weft yarn feeding and storage device, and comprises a signal generator which directs the stoppage of the loom after a predetermined delay time T has elapsed from the moment at which weft yarn breakage is detected. The device comprises an electronic circuit including components which receive signals representative of the speed of the motor shaft and detection of weft yarn breakage. In one embodiment, the motor speed signal is fed to a counter-divider upon detection of weft yarn breakage, which in turn generates a signal after a time inversely proportional to the motor speed. This signal can be fed to a monostable circuit which generates the pulse for stopping the loom, the delay time T being in relation to the detected speed of the motor of the weft yarn feeding and storage device.

4 Claims, 6 Drawing Sheets

WEFT-FEELER WITH AUTOMATIC ADJUSTMENT OF THE DELAY TIME, FOR WEFT FEEDERS OF SHUTTLELESS LOOMS

BACKGROUND OF THE INVENTION

The present invention relates to a weft yarn feeling device for shuttleless looms—of the projectile, or gripper, or fluid jet type—wherein the weft yarn, unwound by being drawn from a fixed spool or bobbin, is intermittently fed to the weaving machine at a uniform and constant tension by a device storing a weft yarn reserve (weft feeder), which is usually controlled by an electric motor with speed variable according to the amount of yarn required by the loom.

Weft yarn feeling devices (or, more simply, weft-feelers) are already normally provided on modern weaving machines, to indicate yarn breakages at the inlet of the loom.

The weft yarn may break in the area between the weft feeder and the loom, while the fabric is being formed, or in the area between the yarn feeding spool and the weft feeder.

In the first case, the weft-feeler stops the loom but cannot obviously prevent the insertion of the broken weft into the fabric: this calls for a subsequent search of the broken weft, with a waste of time and the possibility of permanent damage to the fabric.

In the second case, it is instead possible to prevent the length of broken yarn from being inserted into the fabric, by arranging a weft-feeler at the inlet of the weft feeder (or, rather, between the yarn feeding spool and the weft feeder). On breaking of the yarn, the weft-feeler stops in fact the loom when a certain amount of yarn reserve is still present on the weft feeder drum; this prevents insertion of the broken weft into the fabric. By using a weft-feeler, it will thus simply be necessary to thread again the weft feeder after yarn breakage, thereby gaining time and improving the quality of the fabric.

In the weaving practice it is already known to use, on each weft yarn, a device for feeling and detecting yarn breakage in either of the two aforementioned critical positions, that is:

between the weft feeder and the loom, as described for example in the U.S. Pat. No. 4,051,871;

between the bobbin or spool and the weft feeder, as described for example in U.S. Pat. No. 4,326,564.

The present invention concerns this second type of weft-feeler, essentially consisting of a sensor detecting the presence of yarn, and of an electronic circuit which processes the signal from said sensor.

The sensor of the weft-feeler can detect the yarn motion if it is of the piezoelectric type, or the yarn tension if it is of the mechanical type with microswitch or with Hall effect, or simply the yarn presence if it is of the capacitive or optoelectric type. Other types of sensors can also be used.

It should be noted that in all cases the sensor, whatever type it may be, is not adapted to distinguish whether the yarn is broken or simply motionless or loose, as happens when the weft feeder is not drawing yarn from the spool. Thus, the signal from the sensor, indicating the presence of yarn, should be considered valid only when the weft feeder is moving.

Furthermore, on starting the weft feeder, since the yarn does not instantly reach the right speed or tension or position on the weft-feeler, the sensor may detect a false lack of yarn and needlessly stop the loom.

To prevent this from occurring, it is already known to accept the loom stopping signal only after a certain delay time, said delay having to be adjusted according to the weaving conditions, that is, according to the yarn drawing speed from the spool, which depends on many factors as, for example, the fabric width, the loom speed, the weft insertion program. It should also be borne in mind that too short delay times can cause stopping of the loom for false lack of yarn, and viceversa, that too long delay times cause stopping of the loom too long after the breakage, when all the reserve of the weft feeder is by then exhausted and the broken yarn end has thus been inserted into the fabric, destroying the advantages of the weft-feeler.

From the above it appears evident that the adjustment of the delay time is a critical operation and that, since it also depends on the program of weft insertion into the loom, it involves the need to accept arrangements which may limit the functionality of the device.

It may happen, for instance, that the first step of a program of weft insertion into the fabric, carried out on a loom fed with multicolored weft yarns, may provide for the same weft yarn to be inserted for many consecutive beatings up, thus requiring the choice of a sufficiently short delay time in order to stop the loom before exhausting the yarn reserve. A second step of the weft insertion program may provide for a far shorter frequency, thereby requiring a longer delay time in order to avoid false stopping of the loom.

Even in the absence of such difficulties, the operator still needs to adjust the delay time according to the working characteristics of the loom. This operation adds up to the many already required in order to obtain the highest efficiency of the machine, and it becomes particularly difficult when operating on looms using different colors, wherein a weft feeder and thus also a weft-feeler are provided for each color of weft.

SUMMARY OF THE INVENTION

The primary object of the present invention is therefore to supply a weft-feeler of the aforementioned type, which does not require the help of an operator to manually adjust the delay time. For this purpose, the weft-feeler according to the invention is characterized in that said delay time is automatically adjusted by an electronic circuit of the weft-feeler, in relation to the momentary speed of the weft feeder motor. Preferably, said delay time is adjusted by means of a frequency signal, directly obtained from the same circuit adjusting the motor speed of the weft feeder according to yarn requirements in the loom.

Alternatively—when the motor is a fixed frequency AC motor or a DC motor, or if the motor speed is manually adjustable through a preselector—the delay time is adjusted by means of a signal obtained from a sensor which detects the number of revolutions of the motor.

Said delay time is suitably adjusted in inverse proportion to the motor speed of the weft feeder, with possible correction to reduce the delay time at lower motor speeds.

BRIEF DESCRIPTION OF THE DRAWINGS

The invention will now be described in further detail, with reference to the accompanying drawings, in which.

DESCRIPTION OF THE PREFERRED EMBODIMENT

Figure 1:
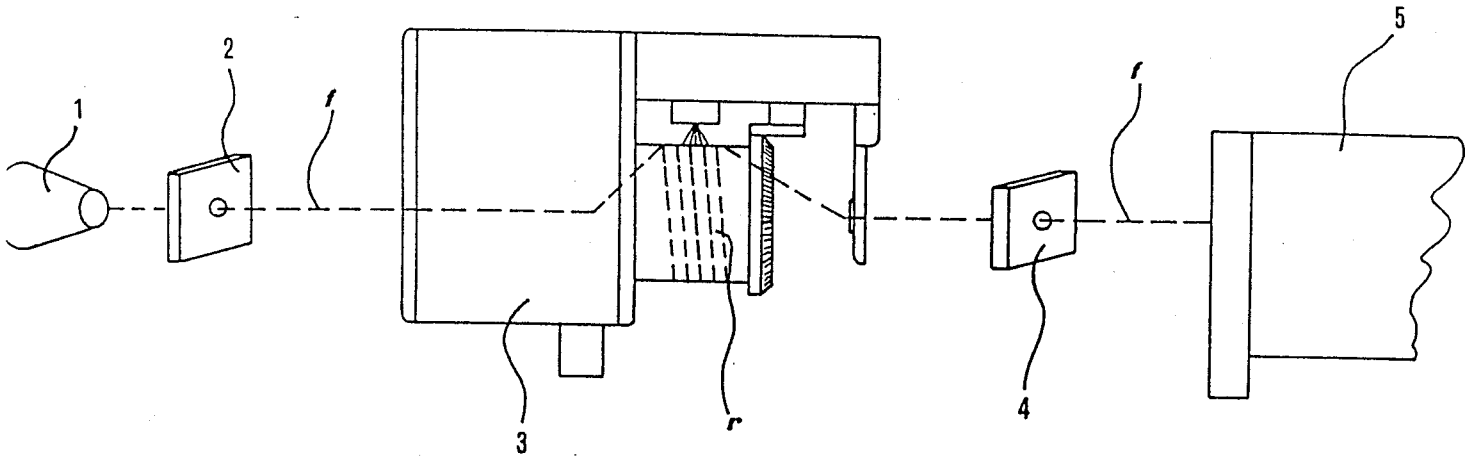
FIG. 1 is the conventional assembly diagram of a weft yarn spool, of a first weft-feeler, of the weft feeder, of a second weft-feeler, and of a loom being fed with the weft yarn wound on the spool.

FIG. 1 shows schematically the conventional arrangement of the members provided on weaving looms in correspondence of the weft inlet side. To start with, there is the bobbin or spool 1 from which the weft yarn f is drawn, this latter passing through a weft-feeler 2 before being let into the weft feeder 3 to form a yarn reserve 4. The weft f is drawn by the loom 5 after passing through a weft-feeler 4 arranged between the weft feeder and the loom.

The weft-feeler 4 is meant to stop the loom if the weft yarn should break or be missing between the weft feeder 3 and the loom 5.

The weft-feeler 2 is meant to stop the loom if the weft yarn should break or be missing between the spool 1 and the weft feeder 3.

Figure 2:
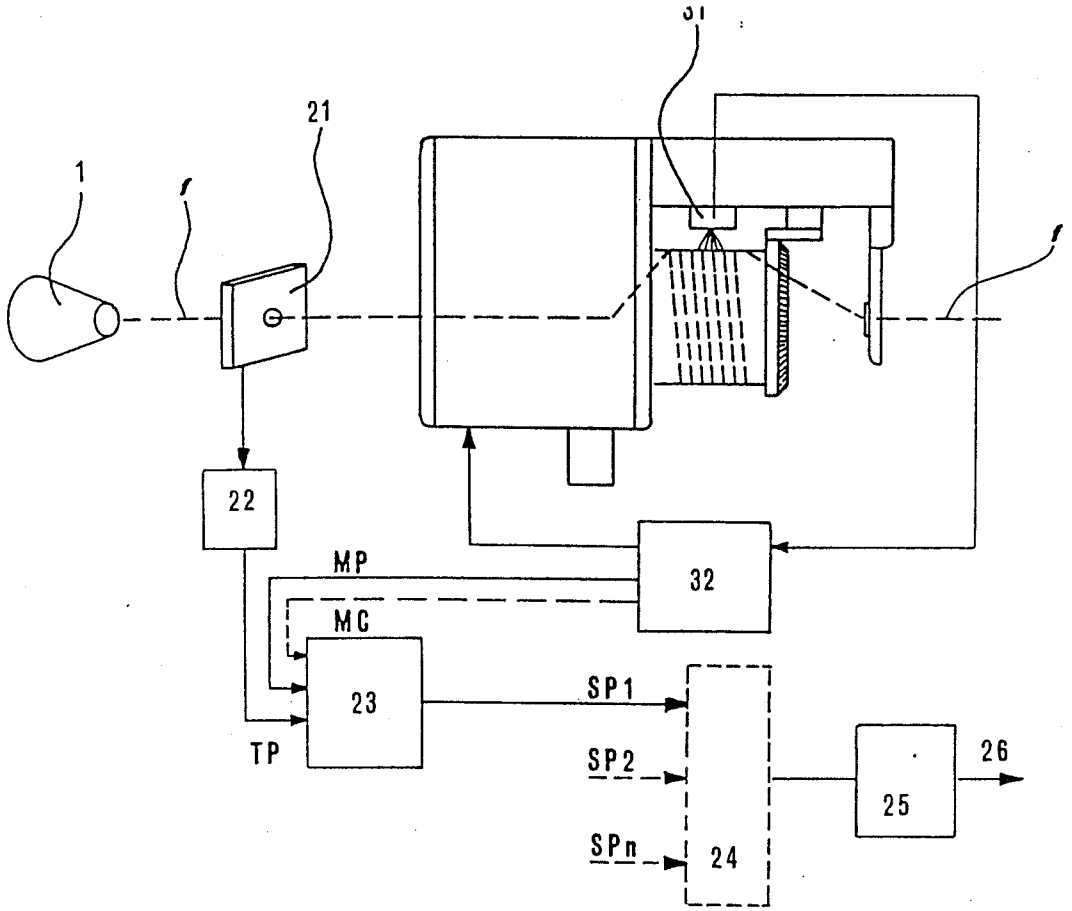
FIG. 2 is a block diagram of the operating system of the first weft-feeler of FIG. 1.

The block diagram of FIG. 2 illustrates the main components of the weft-feeler 2. The weft-feeler is always formed of a sensor 21 and of an electronic circuit 22 suited to the type of sensor used. These two components together generate a TP signal, active when the sensor detects the presence of weft yarn.

As already said, the sensor 21 can be produced using different technologies as, for example, optoelectronic, electromagnetic, piezoelectric, Hall effect, triboelectric, and other solutions.

As known, the weft feeder 3 winds, by means of a rotary arm operated by a motor, a weft yarn reserve r onto a cylindrical drum; said reserve r is controlled by a sensor 31—in the example, a photoelectric sensor—which, through a suitable monitoring circuit 32, operates the motor of the weft feeder 3. The circuit 32 sends a signal MP, which is active only when the motor is caused to rotate.

The signals TP and MP, from the sensor and from the monitoring circuit of the weft feeder, are processed by a logic circuit 23 which generates a signal SP1 if the yarn should break or be missing between the spool and the weft feeder. The signal SP1 is used to control a relay 25 by which the loom is stopped. If working on looms using different colors, similar systems will be provided for each weft yarn. The various signals SP1, SP2, . . . , SPn, will end into an adder circuit 24, the output of which will energize the relay 25 to stop the loom.

Figure 3:
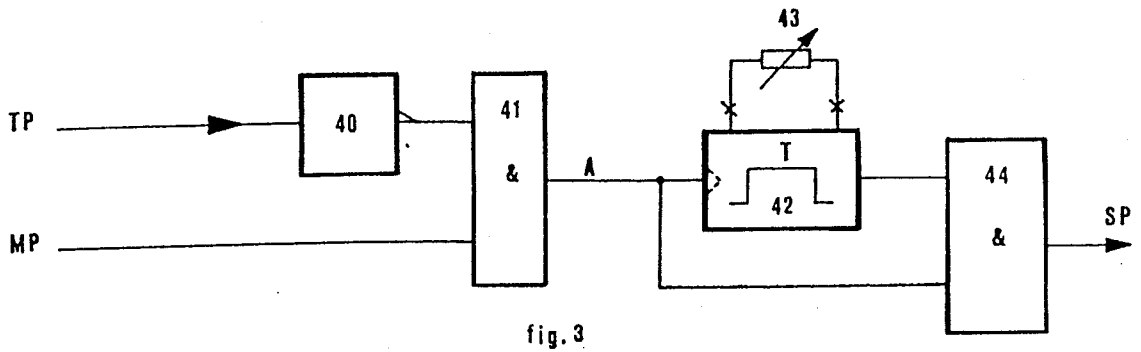
FIG. 3 shows in detail the operating system of the logic circuit forming part of the system of FIG. 2.
Figure 4:
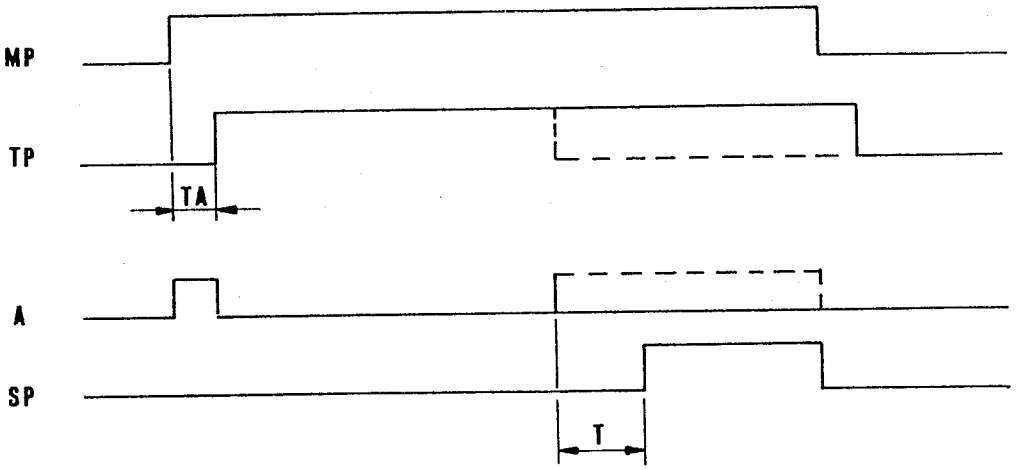
FIG. 4 shows the time curves for the logic system of FIG. 3.

In known technique, the logic circuit 23 processes the signals TP and MP according to the operating system of FIG. 3 and the time curves of FIG. 4; the signal TP, active when the weft is detected by the sensor, is inverted by the signal MP, active when the motor is running, thereby generating a signal A, active only with non-detected weft yarn and running motor (interrupted yarn). To prevent false stopping of the loom, a monostable circuit 42 and an AND circuit 44 are introduced, so that the loom 5 may be stopped by the output signal SP1 from the circuit 23 only when a delay time T has passed, generated by the monostable circuit 42.

The minimum delay time T should be at least equal to the time TA elapsing between the activation of the signal MP starting the weft feeder motor, and the moment in which the weft has sufficient tension and speed to be detected by the sensor 21.l The maximum delay time T should instead be such as to prevent stopping of the loom when the weft yarn reserve on the weft feeder is exhausted or insufficient.

FIG. 4 shows, in dashed lines, the time curves in case of yarn breakage.

Figure 5:
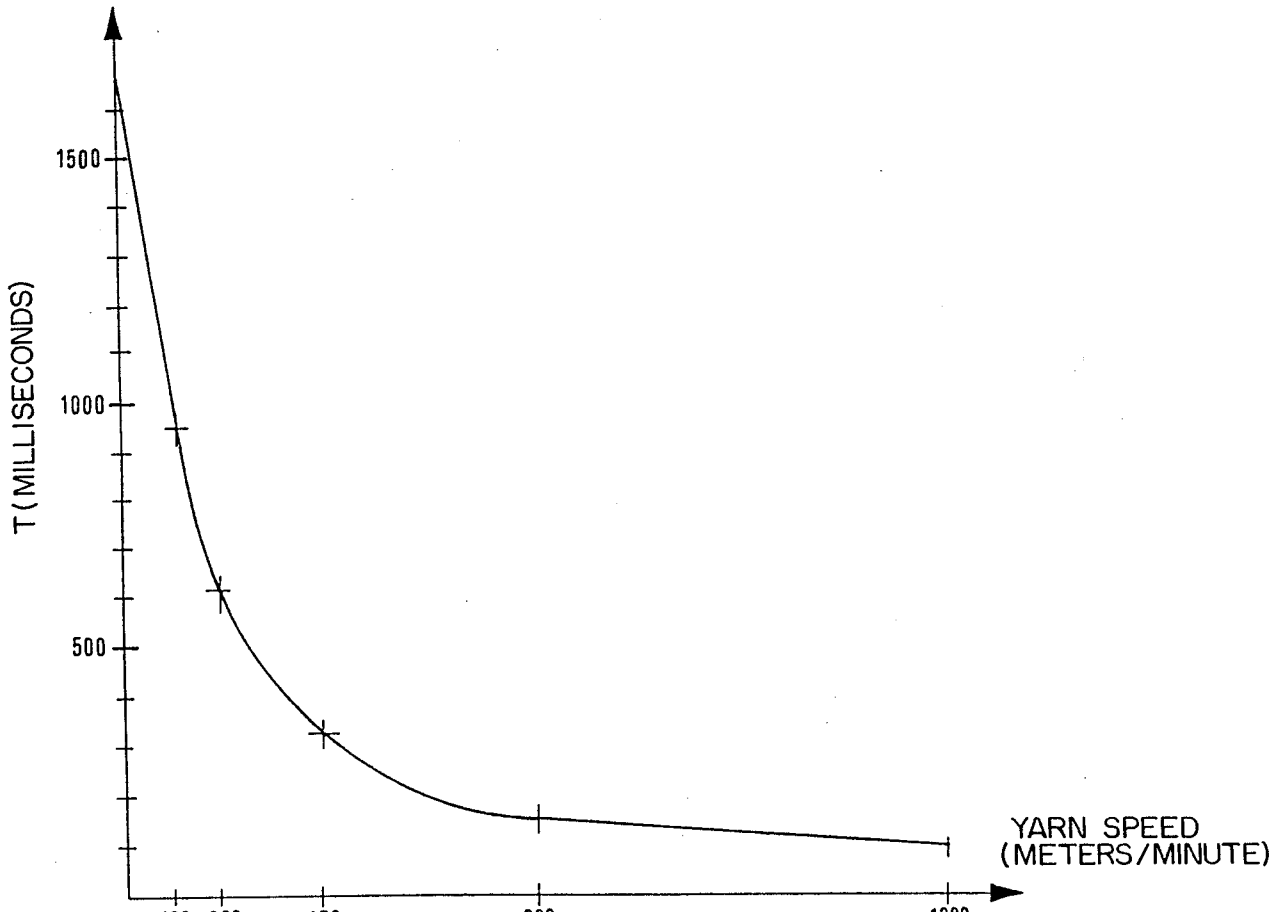
FIG. 5 is a diagram illustrating, by way of example, the ratio between the speed of the weft feeder and the delay time.

FIG. 5 indicates how the delay time T should vary, on varying of the average weft yarn weaving speed, which is in turn equal to the average speed of yarn withdrawal from the spool, and thus to the speed of the weft feeder motor which winds the yarn onto the winding unit.

The object of the present invention is to avoid having to provide for the manual adjustment of the delay time T, one for each weft yarn, on varying of the loom working conditions. The additional information, required to automatically obtain the delay time T, again comes from the weft feeder and supplies the logic circuit 23 with data concerning the rotation speed of the weft feeder motor. This information is already normally provided by the circuits 32, for adjusting the speed of the weft feeder motor, in the form of pulses the frequency of which is proportional to the motor speed. In the event it were not possible to derive this information directly from the circuit of the weft feeder, one could provide for a sensor adapted to generate one or more pulses for each revolution of the motor shaft. In FIG. 2, this signal (from circuit 32 to circuit 23) is indicated by MC.

Figure 6:
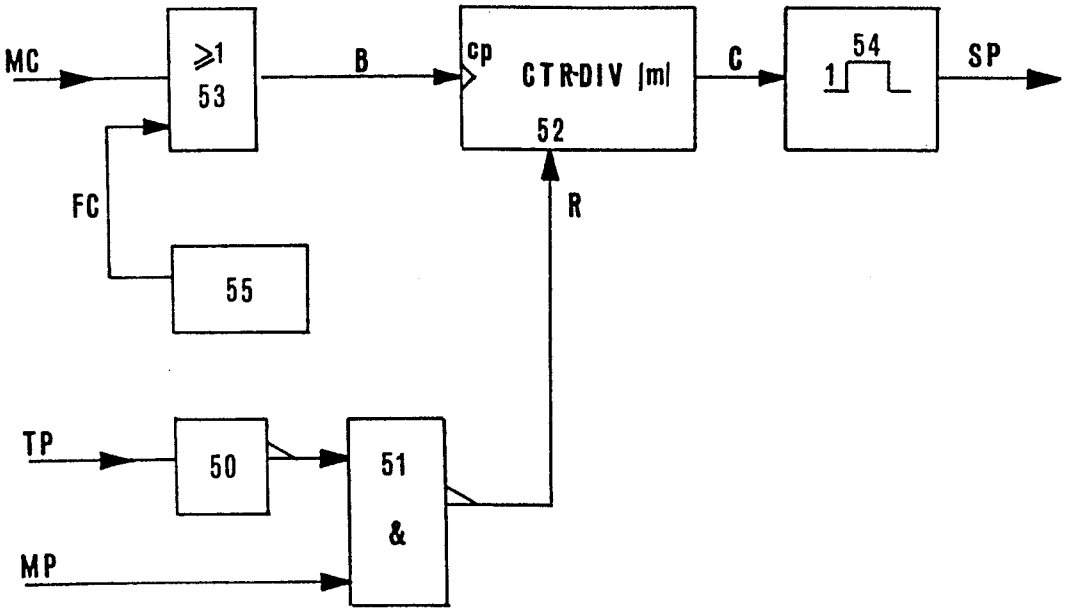
FIG. 6 is a block diagram of the weft-feeler (first weft-feeler in the diagram of FIG. 1) according to the invention.
Figure 7:
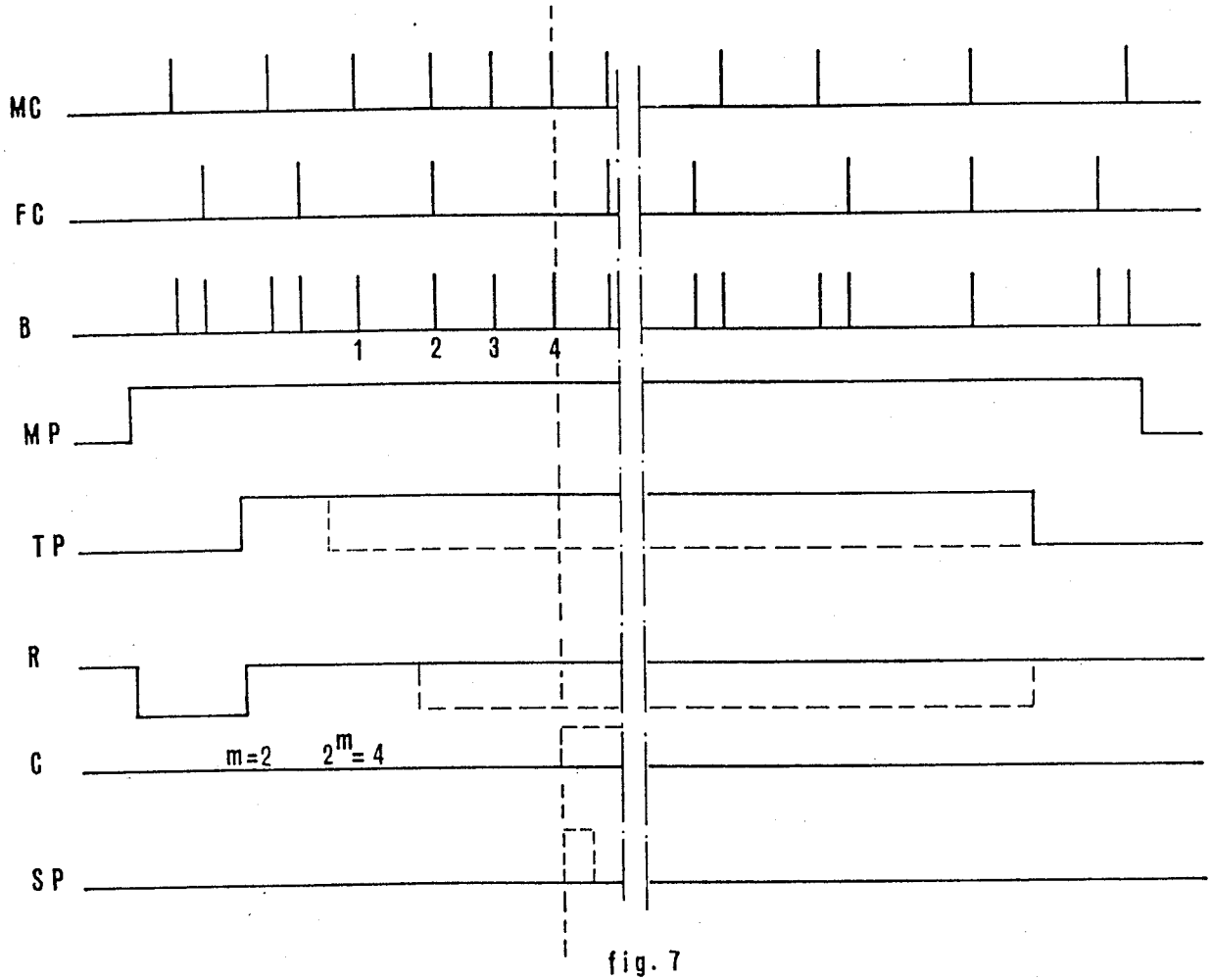
FIG. 7 shows the time curves in relation to the diagram of FIG. 6.

FIG. 6 is a block diagram showing an embodiment of the invention, while FIG. 7 shows the relative time curves. The signal MC (Motor Clock), sent by the circuit 32 of the weft feeder 3, is formed of pulses having a frequency proportional to the rotation speed of the weft feeder motor. The frequency range of the signal MC could for instance vary from 5 Hz to 70 Hz (equal to the frequency required to drive a motor with frequency change control in the speed range of from 300 to 4200 r.p.m.). Furthermore, as already known, the signal MP, also sent from the circuit 32 of the weft feeder 3, is active when the weft feeder motor is running, while the signal TP, sent from the electronic circuit 22 of the sensor 2, is active when the weft is detected by said sensor. This last signal is inverted in the block 50 and, placed in AND with the signal MP in the block 51, it keeps set to zero the counter-divider 52 having the modulus "m" ("m" means that it sends an output signal C after having counted on its input a number of pulses equal to 2 raised to "m"; in FIG. 7, by way of example, M=2).

The diagram of FIG. 5 shows the ratio between the delay time T and the speed of the weft feeder. The ratio between the two magnitudes may not be simply inversely proportional and can be corrected by adding pulses to the signal MC by way of (FIG. 6) the adder 53 and of an oscillator 55 which generates a fixed frequency signal FC. In this case, the delay time T is considerably shortened, especially when working at low speed.

In the event the signal TP should be missing, in the presence of an MP which is active, the signal R generated by the block 51 (FIG. 6) becomes inactive and the counter-divider 52 can start to count the pulses B sent from the adder circuit 53. Supposing, to start with, that the signal FC is null, the counter-divider 52 will send a signal C after a time inversely proportional to the frequency of the signal MC and, thus, to the speed of the weft feeder motor. The signal C will hence in turn generate, by way of the monostable circuit 54, the pulse SP for stopping the loom.

The heretofore described and illustrated embodiment of the invention is evidently just one of the many possible embodiments which can be realized adopting different circuitry techniques. It is therefore understood that the present invention covers any other embodiments and variants differing from the one described, allowing to automatically adjust the delay time T according to weaving requirements, in relation to the speed of the weft feeder motor, by means of an algorithm which can simple be inversely proportional or the like, with correction, especially at the low working speeds.

I claim:

1. A device for detecting weft yarn breakage, said device being adapted to be positioned upstream of a weft yarn feeding and storage device in a shuttleless loom, said device comprising means for detecting weft yarn breakage during operation of a motor of the weft yarn feeding and storage device of the shuttleless loom, and means generating a loom-stoppage signal responsive to detection of a said weft yarn breakage, after a predetermined delay time T has elapsed from detection of a said breakage, wherein said signal-generating means comprises an electronic circuit including means for receiving information indicative of the speed of said motor of said weft yarn feeding and storage device, said electronic circuit automatically adjusting said delay time T in relation to said information indicative of the speed of said motor.

2. The device according to claim 1, wherein said electronic circuit receiving means is adapted to receive a frequency signal indicative of the motor speed, said circuit adjusting said delay time T in relation to said frequency signal.

3. The device according to claim 1, said electronic circuit receiving means being adapted to receive information from a sensor detecting the number of revolutions of the motor, said electronic circuit automatically adjusting said delay time T in relation to input from said sensor.

4. The device according to claim 1, wherein said electronic circuit including means for automatically adjusting the delay time T in inverse proportion to said motor speed, said adjusting means being further adapted to depart from said inverse proportion to reduce said delay time T at lower motor speeds.

* * * * *